US006431922B1

(12) United States Patent
Ko

(10) Patent No.: US 6,431,922 B1
(45) Date of Patent: Aug. 13, 2002

(54) CONNECTOR BEARING HIGH VOLTAGE

(75) Inventor: David Tso-Chin Ko, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/887,864

(22) Filed: Jun. 22, 2001

(51) Int. Cl.[7] ..... H01R 13/432
(52) U.S. Cl. ..... 439/748
(58) Field of Search ..... 439/851, 469, 439/398, 447, 465, 748, 746, 749, 595, 872, 871

(56) References Cited

U.S. PATENT DOCUMENTS 3,654,592 A * 4/1972 Primorac ..... 439/749
3,853,388 A * 12/1974 Heimbrock ..... 439/746
3,932,013 A * 1/1976 Yeager et al. ..... 439/748
5,664,969 A * 9/1997 Peterson et al. ..... 439/748
6,247,965 B1 * 6/2001 Cumming et al. ..... 439/587

* cited by examiner

*Primary Examiner*—Neil Abrams
*Assistant Examiner*—Phuong K. T. Dinh
(74) *Attorney, Agent, or Firm*—Wei Te Chung

(57) ABSTRACT

An electrical connector comprising a housing and a plurality of contacts, the housing having a mating end, a wire-receiving end, an upper and a lower sidewalls, two end walls, a plurality of passageways extending from the mating end to the wire-receiving end, and a plurality of tongue portions formed on the housing each corresponding with one passageway, each tongue portion comprising a cavity formed thereon, a window being formed between each passageway and an associated tongue portion, wherein two tongue portion are formed on the two end walls respectively, the contacts each being received in one passageway and having a spring finger extending through the window into the cavity.

6 Claims, 3 Drawing Sheets

CONNECTOR BEARING HIGH VOLTAGE

BACKGROUND OF THE INVENTION

1. Field of the Invention

The present invention relates to electrical connectors for electrical conductors terminated within a housing, and especially to electrical connectors of which the electrical conductors carry high voltage.

2. Brief Description of the Prior Art

Electrical connectors are used in many electronic systems. It is generally used to connect electrical elements and transmit signals therebetween. The system is usually used to transmit high speed, broadband signal, and it is capable of carrying high voltage.

A traditional connector comprises a housing with a plurality of passageways for electrical contacts terminated therein. A plurality of windows is formed on the housing, each window communicating with one passageway. Each contact comprises a spring finger engaged into the window when the contact is engaged in the passageway to prevent separation of the contact from the housing, such as caused by relative bending or twisting of the contact. Traditionally, the windows are formed on an upper surface of the housing, so the spring fingers of the contacts are extended to the same direction and thus near to each other. When transmitting high voltage signals, the contacts are apt to occur arcing between adjacent spring fingers. Examples of electrical connectors with similar structures are those disclosed in U.S. Pat. Nos. 3,854,787 and 4,772,234.

Hence, an improved electrical connector is required to overcome the disadvantages of the prior art.

BRIEF SUMMARY OF THE INVENTION

The object of the present invention is to provide an electrical connector capable of bearing high voltage without bringing arcing between adjacent signal contacts.

To achieve the above-mentioned objects, a connector in accordance with the present invention comprises a housing and a plurality of contacts, the housing having a mating end, a wire-receiving end, an upper and a lower sidewalls, two end walls, a plurality of passageways extending from the mating end to the wire-receiving end, and a plurality of tongue portions formed on the housing each corresponding with one passageway, each tongue portion comprising a cavity formed thereon, a window being formed between each passageway and an associated tongue portion, wherein two tongue portion are formed on the two end walls respectively, the contacts each being received in one passageway and having a spring finger extending through the window into the cavity.

Other objects, advantages and novel features of the present invention will become more apparent from the following detailed description of the present embodiment when taken in conjunction with the accompanying drawings.

DETAILED DESCRIPTION OF THE INVENTION

Figure 1:
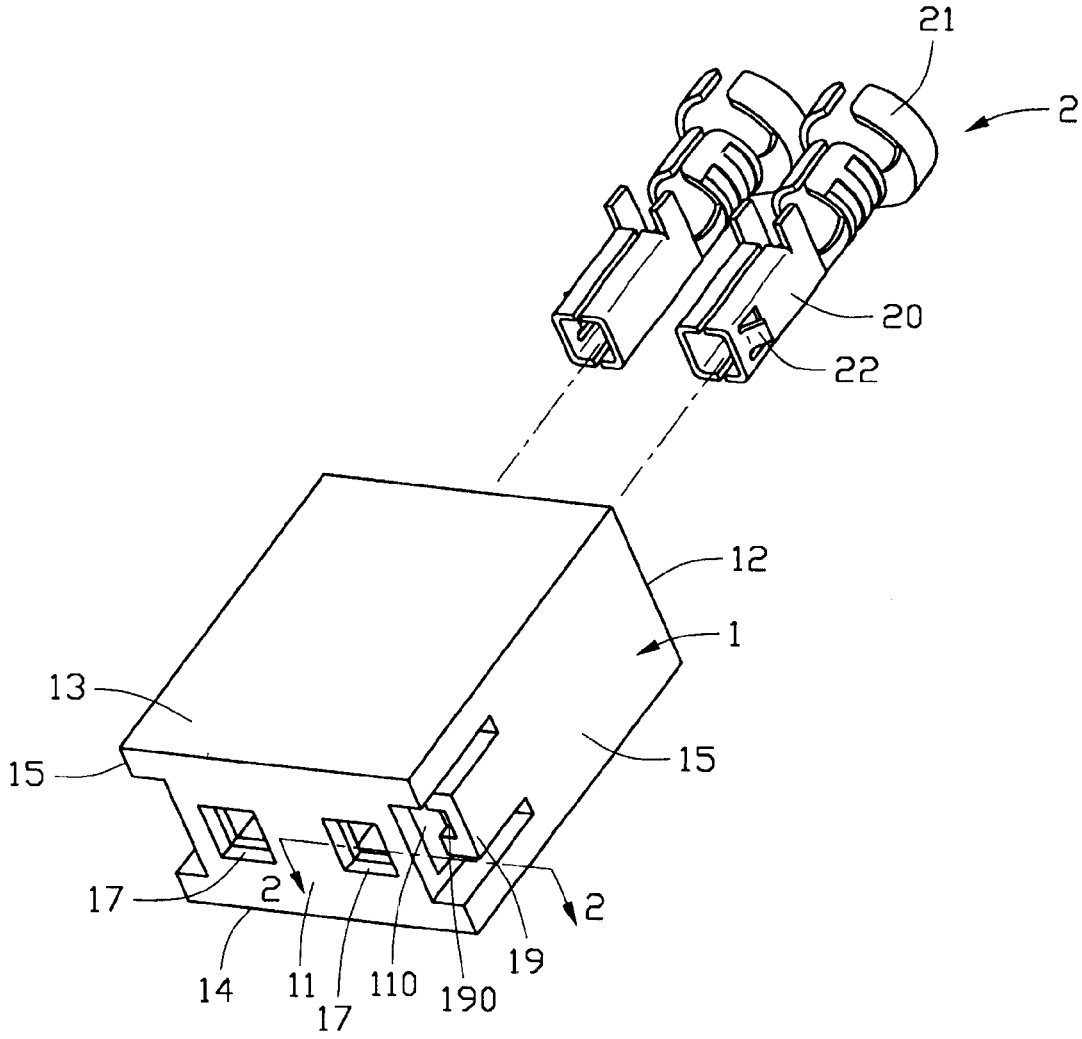
FIG. 1 is a perspective view of a housing and contacts of an electrical connector in accordance with the present invention.

Referring to FIG. 1, an electrical connector of the first embodiment in accordance with the present invention comprises a housing 1 and a pair of contacts 2.

The housing 1 has a mating end 11, a wire-receiving end 12, upper and lower sidewalls 13, 14, and two end walls 15. Two passageways 17 extend through the housing 1 from the end 11 to the end 12 for receiving the contacts 2. The housing 1 further comprises two tongue portions 19 formed on two end walls 15, respectively. The tongue portion 19 extends towards the mating end 11 and has a cavity 190 formed thereon. A window 110 is formed between each passageway 17 and the tongue portion 19.

The contact 2 comprises a mating portion 20 and a barrel portion 21. A spring finger 22 extends outwardly from the mating portion 20. The barrel portion 21 is used to terminate an electrical conductor of a cable (not shown) therein.

Figure 2:
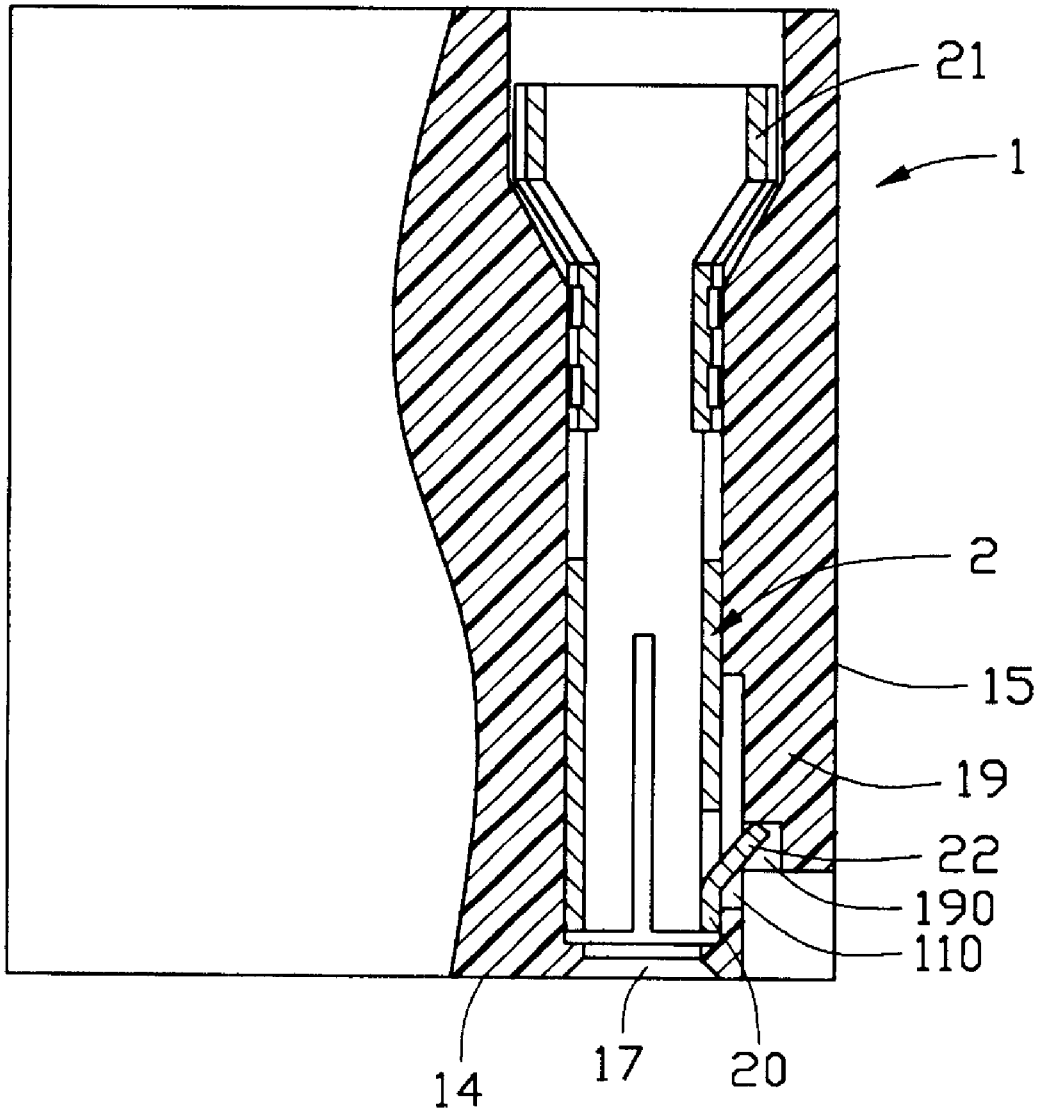
FIG. 2 is a partly cross-sectional view taken along line 2—2 of FIG. 1.

In assembly, referring to FIG. 2, the contacts 2 are mounted into the passageways 17, and the spring finger 22 extends through the window 110 and is received in the cavity 190.

As the two spring fingers 22 are each received in the cavities 190 on two opposite end walls 15 and far away from each other, arcing between two spring fingers 22 is obviated when the connector 100 is used to transmit high voltage signal.

Figure 3:
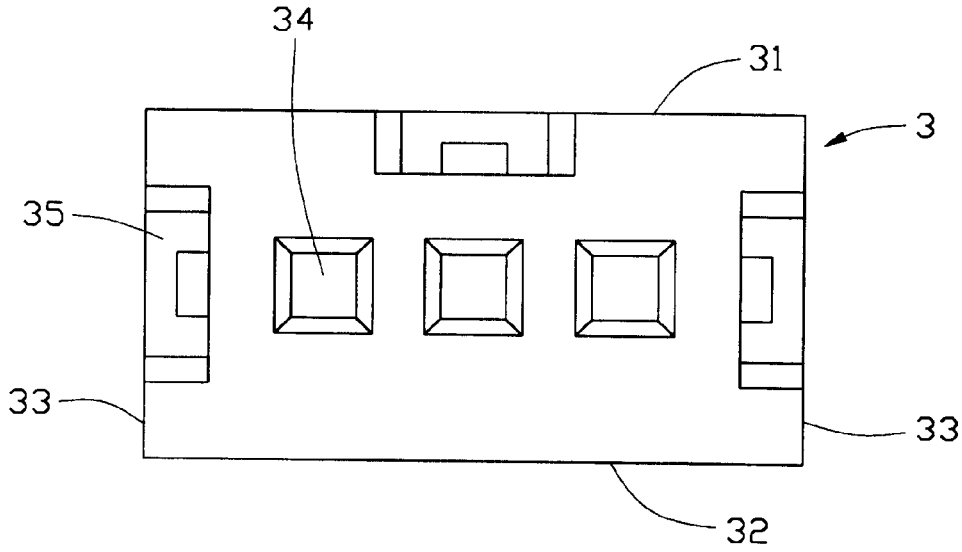
FIG. 3 is a front elevational view of an electrical connector of a second embodiment of the present invention.

FIG. 3 shows the second embodiment in accordance with the present invention. The housing 3 comprisesupper and lower sidewalls 31, 32 and end walls 33, Three passageways 34 are formed in the housing 3 each communicated with one window (not shown) and a tongue portion 35. The tongue portion 35 is in all respects similar to the tongue portion 19 shown in the first embodiment and need not be described in detail. One tongue portion 35 is formed on the sidewall 31, and the other two tongue portions 35 are formed on the end walls 33 respectively.

Figure 4:
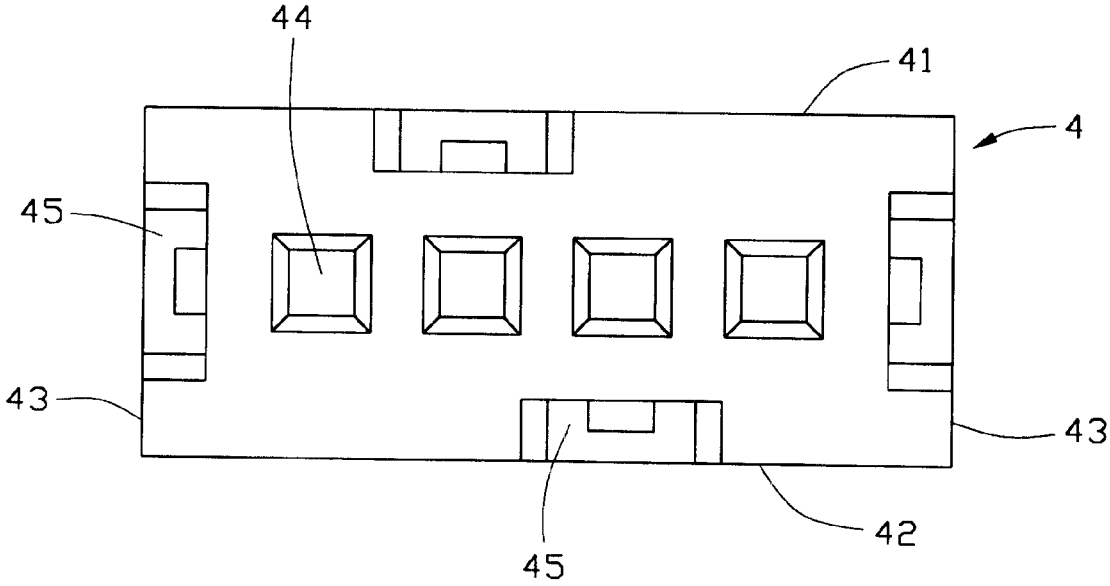
FIG. 4 is a front elevational view of an electrical connector of a third embodiment of the present invention.

FIG. 4 shows the third embodiment in accordance with the present invention. The housing 4 comprisesupper and lower sidewalls 41, 42 and end walls 43. Four passageways 44 are formed in the housing 4 for receiving contacts each communicated with one tongue portion 35. Two tongue portions 35 are formed on the upper sidewall 41 and lower sidewall 42 respectively, the other two tongue portions 35 are formed on the end walls respectively. The tongue portion 45 is in all respects similar to the tongue portion 19 shown in the first embodiment and need not be described in detail. A window (not shown) is formed between each tongue portion 45 and the passageway 44.

The contacts used in the second and third embodiments are similar to the first one. The spring fingers are received in the tongue portions of the housing. These embodiments provide a structure to make the spring fingers be far away from each other and arcing between spring fingers is obviated when the connector is used to transmit high voltage signal.

It is to be understood, however, that even though numerous characteristics and advantages of the present invention have beenset forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing having a mating end, a wire-receiving end, an upper and a lower sidewalls, two end walls, a plurality of passageways extending from the mating end to the wire-receiving end, and a plurality of tongue portions formed on the housing each corresponding with one passageway, each tongue portion comprising a cavity formed thereon, a window being formed between each passageway and an associated tongue portion, wherein two tongue portions are formed on the two end walls respectively;

a plurality of contacts each being received in one passageway and having a spring finger extending through the window into the cavity.

2. The electrical connector as claimed in claim 1, wherein the housing comprises three tongue portions, one tongue portion being formed on one of the upper and the lower sidewalls.

3. The electrical connector as claimed in claim 1, wherein the housing comprises four tongue portions, one tongue portion being formed on the upper sidewall and another tongue portion being formed on the lower sidewall.

4. The electrical connector as claimed in claim 1, wherein the plurality of tongue portions comprises the two tongue portions formed on the end walls and those formed on the upper sidewall and the lower sidewall alternately.

5. An electrical connector comprising:

an insulative housing defining a plurality of passageways along a front-to back direction, and a plurality of walls together surrounding said passageways; and a plurality of contacts disposed in the corresponding passageways, respectively, each of said contacts including a spring finger extending outwardly and laterally relative to the corresponding passageway for preventing said each of the contacts from backward moving out of the corresponding passageway; wherein the spring fingers of said contacts are exclusively directed to different walls, respectively; wherein tongue portions are formed on the corresponding walls beside the corresponding passageways, respectively, each of said tongue portions defining thereof a cavity to receive the spring finger of the corresponding contact.

6. The connector as claimed in claim 5, wherein the tongue portions and the passageways have the same number.

* * * * *